US006282847B1

(12) United States Patent
Mangelsen et al.

(10) Patent No.: US 6,282,847 B1
(45) Date of Patent: Sep. 4, 2001

(54) WORKCELL DOOR AND WALL ASSEMBLY

(75) Inventors: Jan C. Mangelsen, Charlotte; Fred K. Remley, Blue Grass, both of IA (US)

(73) Assignee: Genesis Systems Group, Ltd., Davenport, IA (US)

( * ) Notice: Subject to any disclaimer, the term of this patent is extended or adjusted under 35 U.S.C. 154(b) by 0 days.

(21) Appl. No.: 09/320,936

(22) Filed: May 27, 1999

(51) Int. Cl.[7] ..... E06B 3/40; E04B 2/74

(52) U.S. Cl. ..... 52/36.1; 52/71; 49/246; 49/248; 49/359

(58) Field of Search ..... 52/36.1, 71; 49/216, 49/217, 218, 219, 220, 246, 248, 339, 345, 351, 359, 363; 312/138.1, 139, 139.1, 139.2

(56) References Cited

U.S. PATENT DOCUMENTS 3,051,999 * 9/1962 Schimek ..... 49/216 X
4,268,996 * 5/1981 Allen ..... 49/218 X
4,393,623 * 7/1983 Munz ..... 49/248
4,611,434 * 9/1986 Britzke et al. ..... 49/218 X
4,917,446 * 4/1990 Mariani ..... 49/246 X
5,321,579 * 6/1994 Brown et al. ..... 52/36.1 X
5,394,658 * 3/1995 Schreiner et al. ..... 52/36.1
5,675,946 * 10/1997 Verbeek et al. ..... 52/36.1 X
5,787,648 * 8/1998 O'Malley ..... 52/36.1
5,873,205 * 2/1999 Hanlon et al. ..... 52/64 X
6,030,024 * 2/2000 Schmidhuber et al. ..... 49/218 X
6,094,866 * 8/2000 Busnelli ..... 49/219
6,141,908 * 11/2000 Bowen ..... 49/246 X

* cited by examiner

*Primary Examiner*—Laura A. Callo
(74) *Attorney, Agent, or Firm*—Zarley, McKee, Thomte, Voorhees & Sease

(57) ABSTRACT

An improved workcell is provided with a door hinged at a midpoint between the opposite sides and maintained in a parallel relationship to the workcell access opening, thereby minimizing the clearance space required to open and close the door. The workcell is formed of a plurality of posts and wall panels which can be quickly and easily assembled and disassembled, such that the workcell is portable. The wall panels are pinned to the posts and include hollow ribs to receive cabling, wiring, and tubing for work functions within the workcell.

16 Claims, 8 Drawing Sheets

WORKCELL DOOR AND WALL ASSEMBLY

BACKGROUND OF THE INVENTION

Industrial workcells or work stations are well known for housing and isolating manufacturing work, particularly automated work such as that performed by robotics. Such workcells include an access opening to permit an operator to enter the interior work area for various purposes, such as positioning a work piece, checking progress of the work, etc. Often times a door is provided for the access opening, with the door normally being closed while work is performed within the workcell. In the prior art, such door typically have been hinged along one side to the workcell, thereby requiring a clearance space to open the door, with the depth of the space being at least as great as the width of the door so as to permit the door to fully open. Problems arise with work area entry and exit of people and work pieces in such side-mounted doors when there is insufficient space to permit full opening of the door. Thus, it is desirable to have a workcell that occupies minimal floor space while permitting full opening of the workcell door.

The prior art workcells also are typically fixed in location within a manufacturing facility. The walls of the workcell are usually made of steel or other heavy weight, high strength material. However, as work projects within a manufacturing facility change, it may be desirable to modify the layout of one or more workcells. Thus, a portable workcell is desirable.

Accordingly, a primary objective of the present invention is a provision of an improved workcell for the manufacturing industry.

Another objective of the present invention is the provision of a workcell that requires minimal floor space.

A further objective of the present invention is the provision of workcell with an improved door that is moveable between open and closed positions with a minimum of space requirements.

Another objective of the present invention is the provision of a workcell door that is pneumatically or hydraulically controlled for movement between open and closed positions.

Another objective of the present invention is the provision of a portable workcell with wall panels that can be quickly and easily assembled and disassembled.

A further objective of the present invention is the provision of a portable workcell constructed of lightweight, high strength, durable wall panels.

These and other objectives become apparent from the following description of the invention.

SUMMARY OF THE INVENTION

The improved workcell of the present invention includes a door which is pivotally mounted to the door frame adjacent the access opening in the workcell, such that the door is maintained in a plane parallel to the opening as the door moves between open and closed positions. The door hinges are pivotally connected at opposite ends to the workcell frame and to the midpoint of the door, thereby minimizing the clearance distance required to open and close the door. The swinging movement of door between the open and closed positions is controlled by a pneumatic or hydraulic cylinder.

The improved workcell of the present invention is also portable, being comprised of a plurality of wall panels, which are quickly and easily assembled on support posts with the use of elongated pins. Each post includes upper and lower tabs, and each side of the wall panel has a collar adapted to be positioned between and aligned with the tabs, such that the pins are extendable through the aligned upper tab, collar, and lower tab. Removal of one pin allows the panel to be used as a conventional style door which pivots about the remaining pin. The panels are made from lightweight, high strength HDPE and have a unitary construction.

DETAILED DESCRIPTION OF THE DRAWINGS

Figure 1:
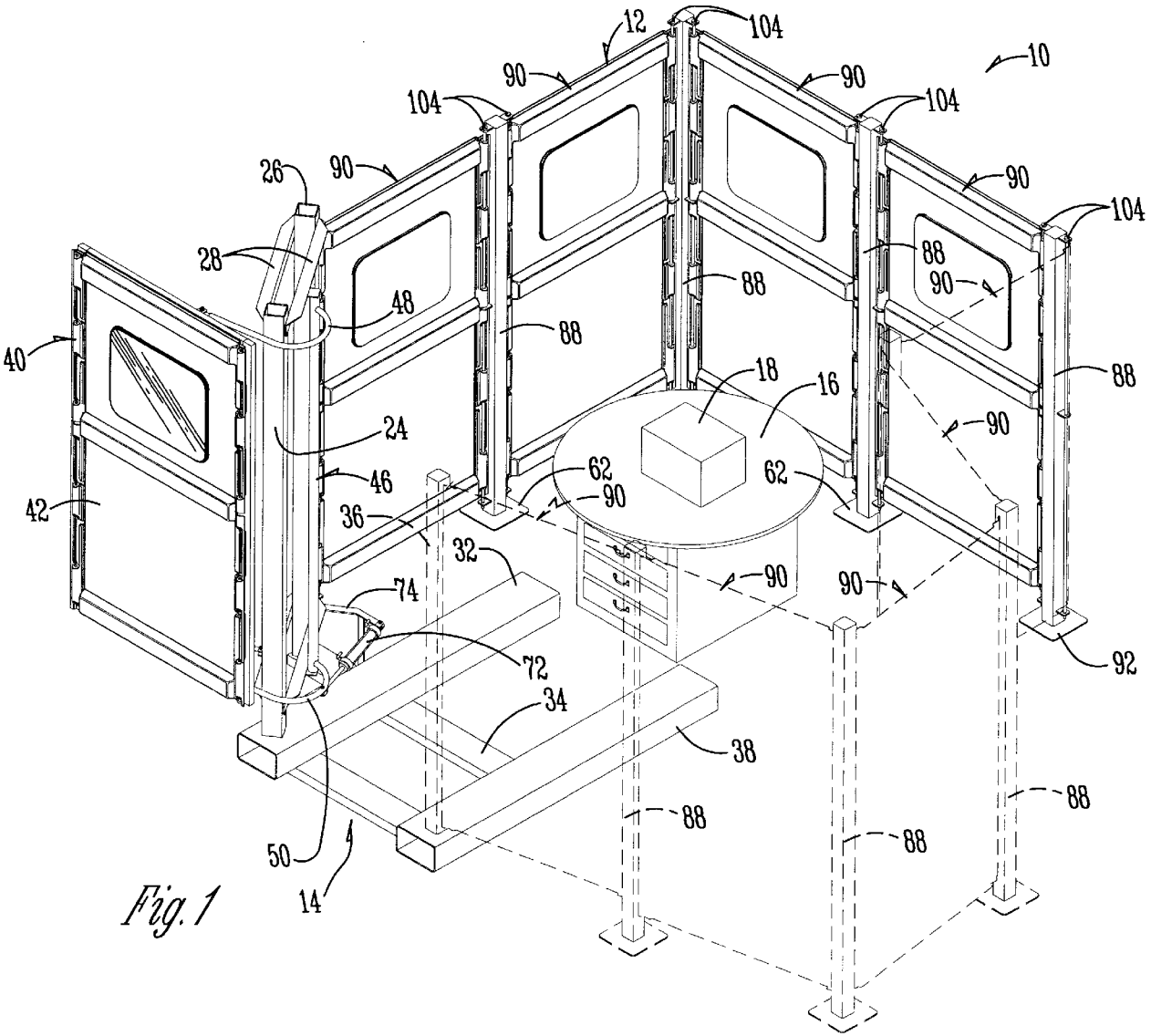
FIG. 1 is a perspective view of the improved portable workcell of the present invention with the minimum clearance door and portable wall panel construction.

The improved workcell or work station of the present invention is generally designated in the drawings by the reference numeral 10. The workcell 10 includes a perimeter wall 12, which can have any desired configuration. An access opening 14 is provided in the wall to allow an operator to enter the workcell 10. A work table 16 is provided within the workcell 10 for holding an object or piece 18 to be worked. Any type of work may be performed in the workcell 10. For example, a robotic arm operatively connected to a control system (not shown) may perform work on the piece 18 in the workcell 10.

Figure 2:
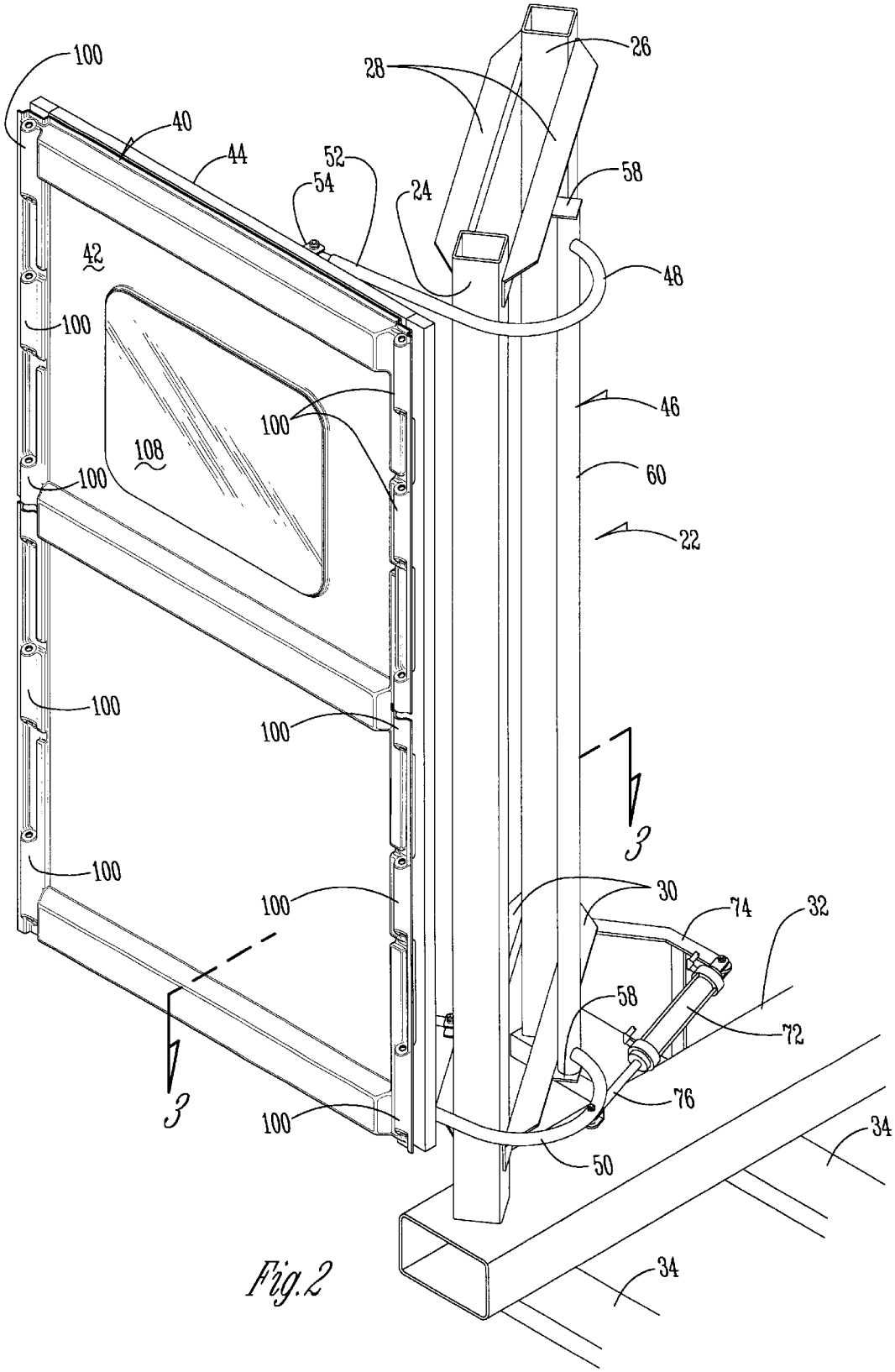
FIG. 2 is an enlarged perspective partial view showing the workcell door in an open position.

A workcell frame 22 is provided on at least one side of the access opening 14. As best seen in FIG. 2, in the preferred embodiment, the workcell frame 22 includes exterior and interior posts 24, 26, respectively, with upper and lower cross bars 28, 30, respectively, extending between the posts 24, 26. The posts 24, 26 are fixed upon floor members 32, 34 so as to be in an upright position. An opposite side of the workcell frame 22 includes another upright post 36 extending upwardly from a floor member 38. Floor members 32 and 38 are hollow and preferably spaced at a distance so as to be adapted to receive the tines of a forklift for movement of the workcell frame 22.

A door 40 is provided on the workcell 10 for movement between open and closed positions relative to the access opening 14. The door 40 includes a door panel 42 mounted upon a perimeter frame 44. Preferably, the door panel 42 is made of a unitary construction from light weight, high strength material, such as high density polyethylene (HDPE). HDPE is particularly desirable for workcells housing a welding process, since HDPE is resistant to the ultraviolet rays and indirect flame from welding. The frame 44 may be made of metal or other suitable material.

A hinge assembly 46 mounts the door 40 to the workcell frame 22. The hinge assembly 46 includes an upper hinge 48 and a lower hinge 50. Each of the hinges 48, 50 includes an outer end 52 which is pivotally connected to a tab 54 extending rearwardly from the perimeter door frame 44. The inner ends 56 of the hinges 48, 50 are pivotally connected to the workcell frame 22. More particularly, the frame 22 includes tabs 58 extending from the upper and lower cross bars 28, 30. The inner ends 56 of the hinges 48, 50 are welded or otherwise secured to a tube 60 which is journaled between the tabs 58 on the upper and lower cross bars 28, 30. Stub shaft 62 extends from the tabs 58 into the tube 60 to rotatably support the tub 60.

A secondary stabilizer arm 64 is provided at door 40. The arm 64 has an outer end 66 pivotally connected to the perimeter doorframe 44 and an inner end 68 pivotally connected to a tab 70 extending from the lower cross bar 30.

Figure 3:
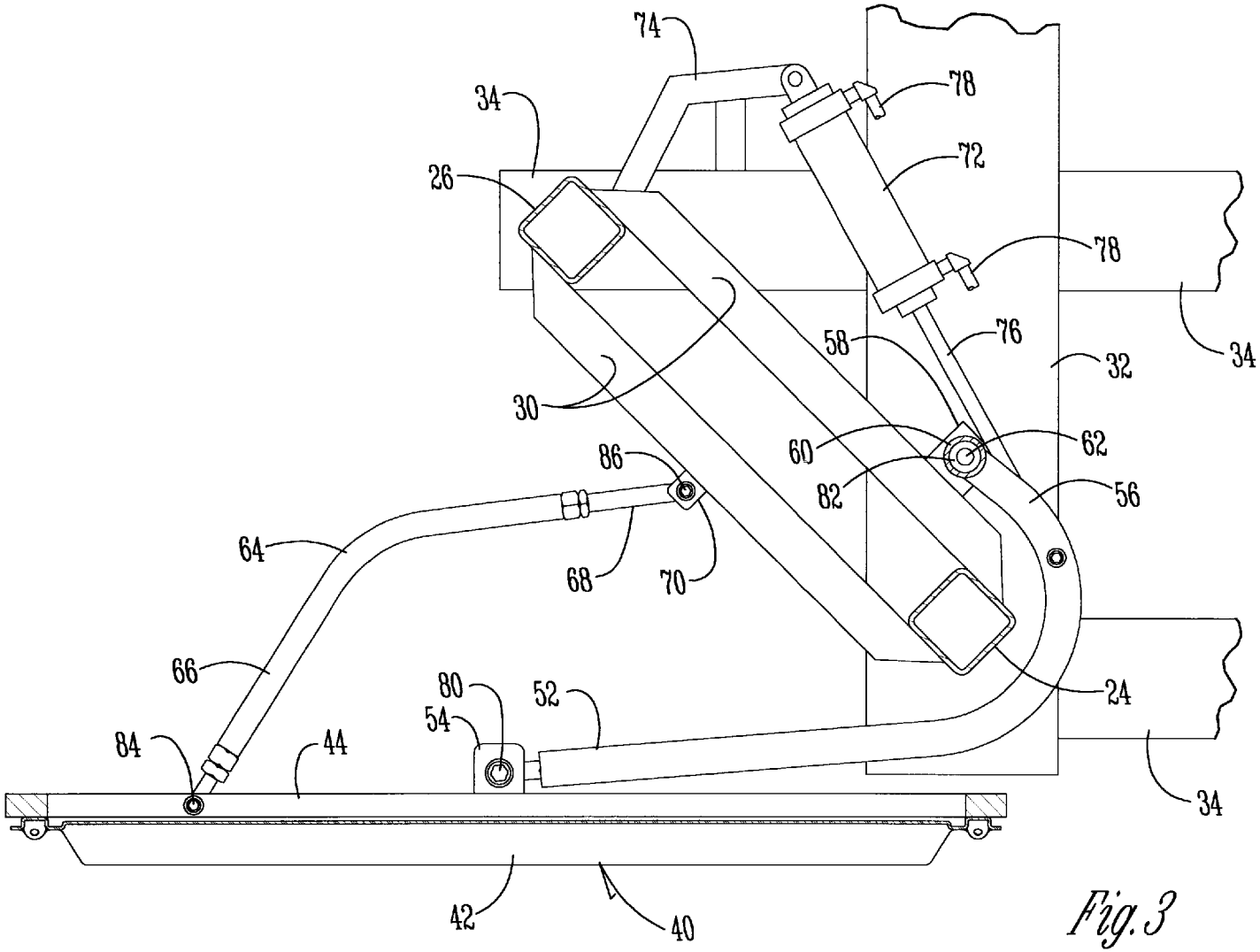
FIG. 3 is a sectional view taken along lines 3—3 of FIG. 2, with the door in an open position.
Figure 4:
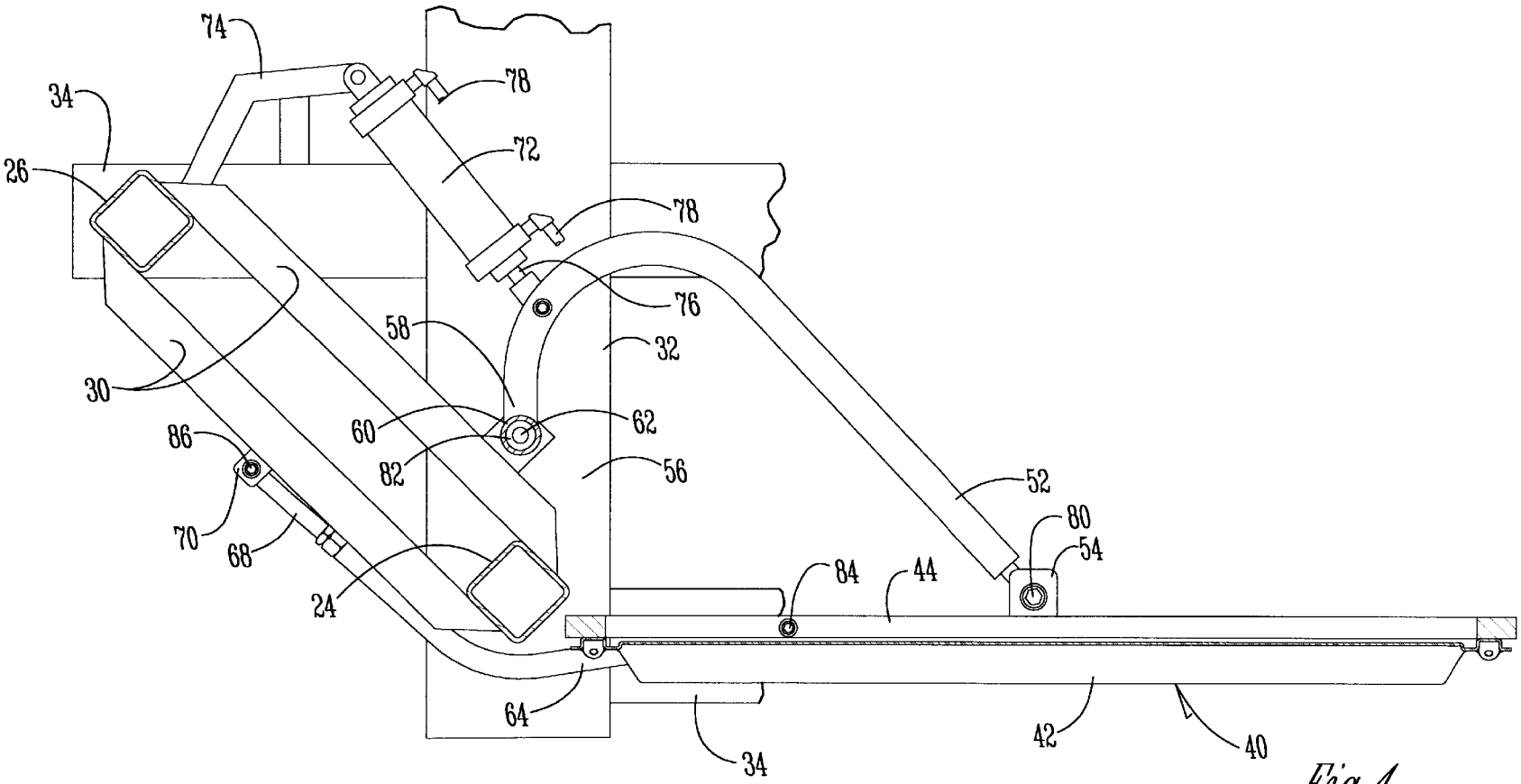
FIG. 4 is a view similar to FIG. 3 showing the door in a closed position.

The hinges 48, 50 and the secondary arms 64 are curved or bent, as seen in FIGS. 3 and 4. A pneumatic or hydraulic cylinder 72 is provided for moving the door 40 between the open and closed positions relative to the workcell access opening 14. The cylinder is mounted on a bar 74 of the workcell frame 22, with the piston arm 76 of the cylinder 72 being pivotally connected to the lower hinge 50, as shown in FIGS. 2–4. Air or fluid lines 78 are operatively connected to the cylinder 72. The cylinder 72 is preferably low pressure (30–40 pounds) so as to prevent injury or damage if there is an obstruction blocking the opening or closing of the door 40, and so as to eliminate the need for a sensor to sense an obstruction.

Preferably, the cylinder 72 is actuated by the operator pushing a button or switch operatively connected to a solenoid (not shown) so as to extend the piston arm 76 to open the door 40, as shown in FIG. 3, or retract the piston arm 76 to close the door 40, as shown in FIG. 4. The pivot axes 80, 82 at the ends of the hinges 48, 50 and the pivot axes 84, 86 at the ends of the secondary arm 64 cause the door to be maintained in a plane parallel to the access opening 14 throughout movement between the open and closed positions. Thus, the angle of the plane defined by the door 40 remains constant.

Figure 5:
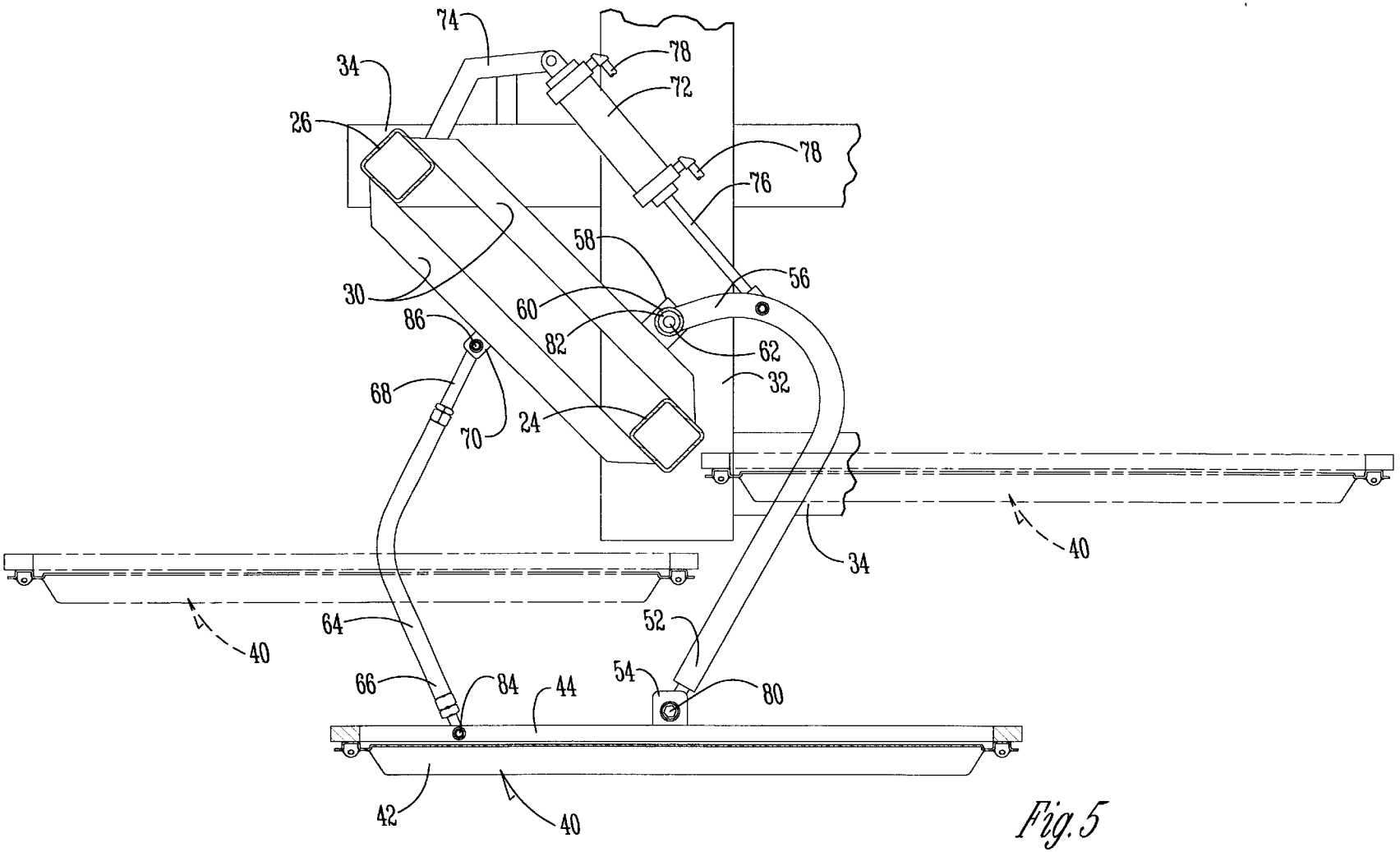
FIG. 5 is a view similar to FIGS. 3 and 4 and shows the door in a maximum clearance position between the open and closed positions, which are drawn in broken lines.

The location of the door tabs 54 at the approximate midpoint between the opposite edges of the door 40, in conjunction with the swinging motion of the door, minimizes the space required to open and close the door. More particularly, the location of the pivot axes 80 near the center of the door produces a clearance distance substantially less than the width of the door, as is necessary in a conventional door hinged along one edge. The maximum clearance distance is shown in FIG. 5.

The workcell 10 of the present invention is also designed to be portable, with quick and easy assembly of the walls 12 and door 40. The workcell 10 generally includes a plurality of upright posts 88 to which wall panels 90 are attached. Each wall panel 90 has the same basic construction as the door panel 42.

Figure 6:
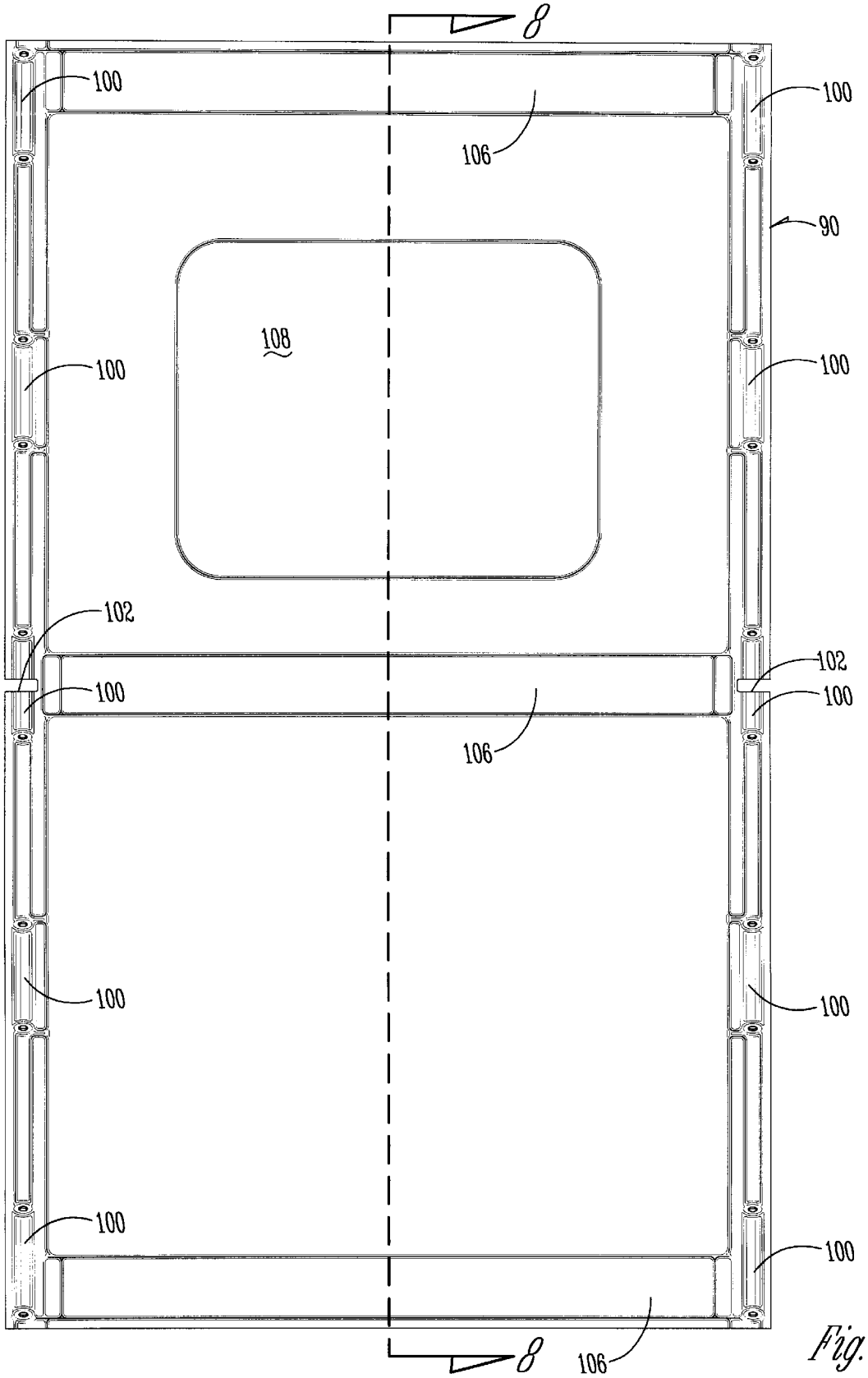
FIG. 6 is a front elevation view of a wall panel for the improved workcell of the present invention.
Figure 7:
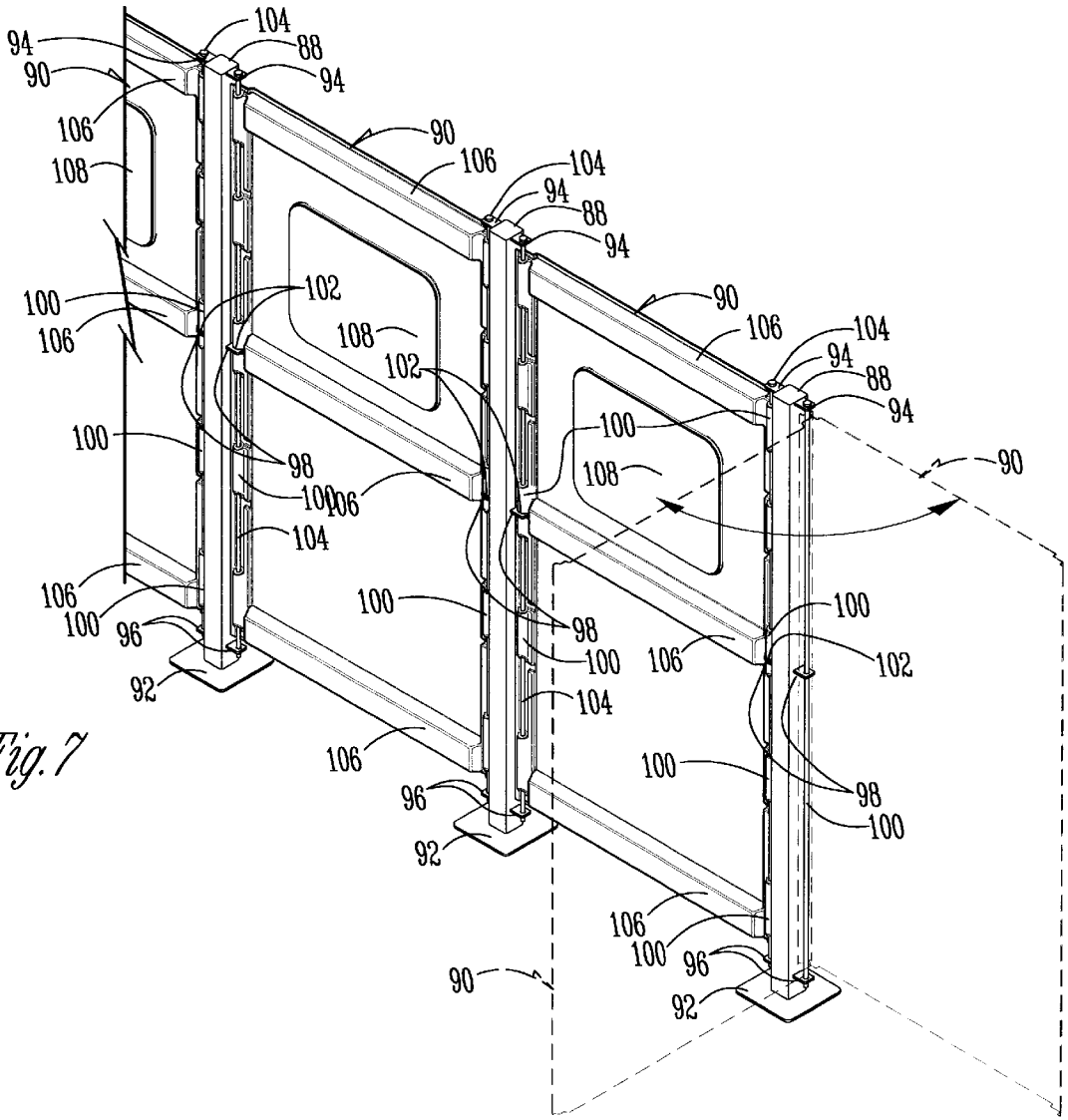
FIG. 7 is a perspective view showing a section of the workcell with multiple wall panels.
Figure 8:
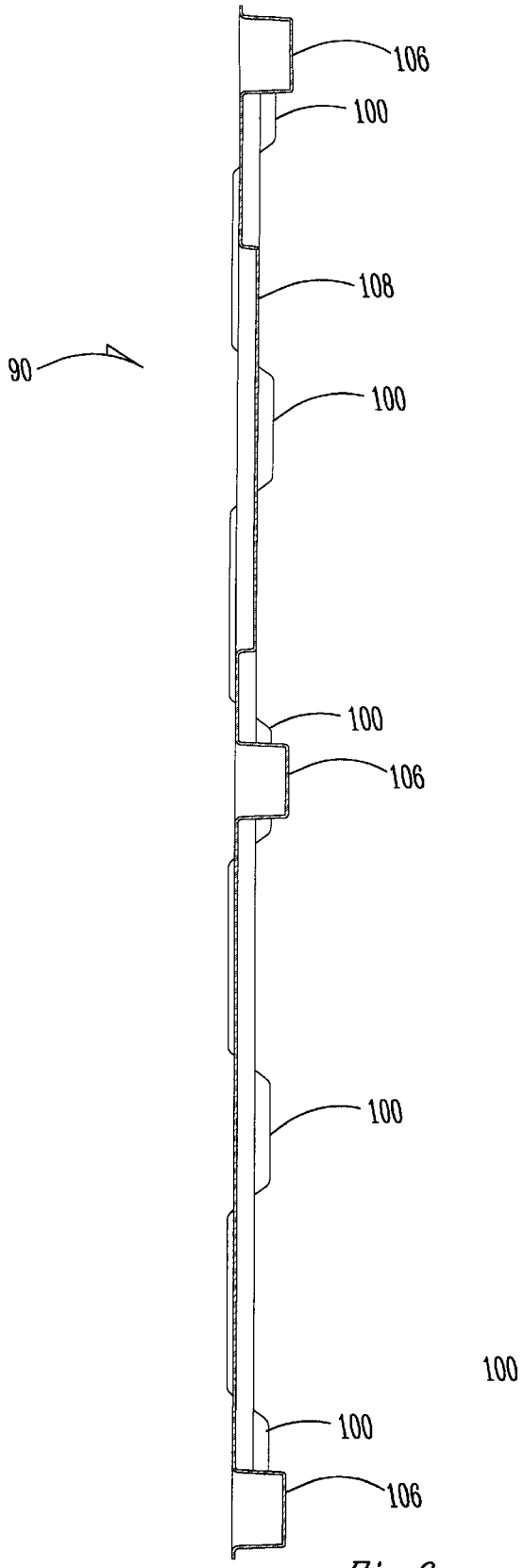
FIG. 8 is a sectional view taken along lines 8—8 of FIG. 6.

As shown in FIGS. 6–8, the posts 88 include a base 92 which allows the posts to be free standing. Alternatively, the base 92 may be anchored to the floor. The posts include oppositely extending upper and lower tabs 94, 96. Central posts tabs 98 may also be provided depending on the height of the posts.

The wall panels 90 include opposite sides with a collar 100 extending along each side. The collar 100 is hollow and may be sectionalized, as shown in the drawings, or may be continuous. The collar 100 on each side of a wall panel 90 is adapted to be received between the upper and lower post tabs 94, 96, as best seen in FIG. 7. A slot 102 is provided in each edge of the wall panels 90 for receiving the central post tab 98, as seen in FIG. 6. An elongated rod or pin 104 is adapted to extend through the upper post tab 94, the collar 100, the central post tab 98, and the lower post tab 96 so as to pivotally secure the respective side of the wall panel 90 to the respective post 88.

Thus, multiple wall panels 90 can be assembled together to form the workcell walls 12. The pin 104 provides a pivotal connection between the wall panel 90 and the respective post 88, such that each panel can be set in an angular relationship with respect to the adjacent panel, as shown by dotted lines in FIG. 7.

The wall panels 90 are preferably made of HDPE material so as to be lightweight for easy assembly and disassembly of the workcell 10, yet high strength such that the workcell is durable. The panels 90 also include reinforcing ribs 106, which are preferably hollow to allow work lines, such as cabling, wiring, and tubing, to be extended therethrough as needed for the work operations within the workcell 10. A window 108 may be provided in the wall panels 90 and the door panel 42 so as to allow observation of the work piece and process by an operator.

The preferred embodiment of the present invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

What is claimed is:

1. An improved workcell having an interior work area and a planar opening providing access to the work area, the improvement comprising:

a frame extending along at least a portion of the workcell opening;

a door adapted to move between open and closed positions relative to the workcell opening; and a first hinge having a first end pivotally connected to the door and a second end pivotally connected to the frame so as to mount the door to the frame and so as to maintain the door in a plane parallel to the opening as the door moves between the open and closed positions;

a stabilizer arm having a first end pivotally connected to the door and a second end pivotally connected to the frame to facilitate movement of the door between the open and closed positions; and whereby the ends of the hinge and stabilizer arm are free from the workcell opening when the door is opened.

2. The improved workcell of claim 1 further comprising a power cylinder for moving the door between the open and closed positions.

3. The improved workcell of claim 2 wherein the power cylinder has a first end operatively connected to the frame and a second end connected to the first hinge.

4. The improved workcell of claim 1 further comprising a second hinge spaced from the first hinge and having first and second ends connected to the door and to the frame, respectively.

5. The improved workcell of claim 4 wherein the first and second hinges are interconnected.

6. The improved workcell of claim 1 wherein the first hinge is curved.

7. The improved workcell of claim 1 wherein the door has opposite side edges, and the first hinge is connected to the door approximately midway between the side edges.

8. An improved workcell having an interior work area and a planar opening providing access to the work area, the improvement comprising:

a frame;

a door having opposite side edges defining a door width;

hinges to pivotally mount the door to the frame, the hinges being connected to the door at a location between the opposite edges of the door such that the door swings between open and closed positions in a space less than the door width;

a stabilizer arm having a first end pivotally connected to the door and a second end pivotally connected to the frame to facilitate movement of the door between the open and closed positions; and whereby the stabilizer arm is out of the workcell opening when the door is opened.

9. The workcell of claim 8 wherein the hinges are connected to the frame at a location inwardly of the opening.

10. The workcell of claim 8 wherein the hinges have opposite ends with pivot about spaced apart axes such that the door remains parallel to the opening during movement between the open and closed positions.

11. The workcell of claim 8 wherein the hinges include a first end connected to the door at a location substantially midway between the opposite edges of the door such that the swinging movement of the door between open and closed positions defines a clearance distance substantially less than the width of the door.

12. The workcell of claim 8 further comprising a power cylinder to move the door between the open and closed positions.

13. A method of moving a workcell door between open and closed positions relative to an access opening in the workcell, the door having opposite side edges and the door being mounted on a frame in the workcell, the method comprising;

pivoting the door about a first pivot access located substantially midway between the opposite sides of the door;

maintaining the door in a plain parallel to the access opening throughout movement between the open and closed positions; and maintaining the access opening substantially free of door mounting hardware when the door is in the open position.

14. The method of claim 13 further comprising moving the door with a power cylinder.

15. The method of claim 13 further comprising moving the door through a clearance zone extending from the opening, the zone having a depth which is less than the width of the door.

16. The method of claim 13 further comprising pivoting the door about a second pivot axes located inwardly from the access opening.

* * * * *